US008630567B2

(12) United States Patent
Makino

(10) Patent No.: US 8,630,567 B2
(45) Date of Patent: Jan. 14, 2014

(54) CHARGING DEVICE HAVING MOVABLE HOLDING MEMBER FOR SHUTTER AND IMAGE FORMING APPARATUS HAVING THE SAME

(75) Inventor: Yuichi Makino, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 13/042,161

(22) Filed: Mar. 7, 2011

(65) Prior Publication Data

US 2011/0222900 A1 Sep. 15, 2011

(30) Foreign Application Priority Data

Mar. 9, 2010 (JP) ..... 2010-052016

(51) Int. Cl.
*G03G 15/02* (2006.01)

(52) U.S. Cl.
USPC ..... 399/172; 399/170; 399/98

(58) Field of Classification Search
USPC ..... 399/98, 170, 100
See application file for complete search history.

(56) References Cited

U.S. PATENT DOCUMENTS

| | | | | |
|---|---|---|---|---|
| 5,504,560 | A * | 4/1996 | Kitagaki et al. | 399/168 |
| 7,599,642 | B2 | 10/2009 | Nakajima | |
| 2009/0136253 | A1* | 5/2009 | Nakajima et al. | 399/100 |
| 2010/0111554 | A1* | 5/2010 | Kidaka | 399/66 |
| 2011/0222897 | A1* | 9/2011 | Makino | 399/92 |
| 2011/0222898 | A1* | 9/2011 | Kidaka | 399/97 |
| 2011/0222899 | A1* | 9/2011 | Kidaka | 399/98 |
| 2011/0222901 | A1* | 9/2011 | Makino | 399/98 |
| 2011/0222909 | A1* | 9/2011 | Kidaka | 399/170 |

FOREIGN PATENT DOCUMENTS

JP 2008-046297 A 2/2008

* cited by examiner

*Primary Examiner* — David Gray
*Assistant Examiner* — Tyler Hardman
(74) *Attorney, Agent, or Firm* — Canon USA Inc. IP Division

(57) ABSTRACT

A corona charger conventionally includes a sheet-like shutter and a holding member configured to hold an end of the shutter, and the replacement of a charging electrode is difficult. To solve this problem, the holding member configured to hold the end of the shutter is set to be movable along the longitudinal direction of a shield to a winding member of the shutter more than a supporting member configured to replaceably support the charging electrode.

12 Claims, 12 Drawing Sheets

CHARGING DEVICE HAVING MOVABLE HOLDING MEMBER FOR SHUTTER AND IMAGE FORMING APPARATUS HAVING THE SAME

BACKGROUND OF THE INVENTION

1. Field of the Invention

The present invention relates to a charging device used for an image forming apparatus such as a copying machine, a printer, or facsimile machine.

2. Description of the Related Art

An electrophotographic image forming apparatus forms a toner image on a charged photosensitive member. As an example of a device that charges a photosensitive member, there is a corona charger that performs corona discharge. The corona charger generates a discharge product such as ozone $O_3$ or nitrogen oxide $NO_x$ because the photosensitive member is charged by using the corona discharge.

When the discharge product generated by using the corona discharge is adhered to the photosensitive member, moisture from the air is absorbed and surface resistance is thus reduced. In particular, under a high-humidity environment, an electrostatic latent image corresponding to image information cannot be accurately formed at the adhesion portion of the discharge product (this problem is referred to as "image deletion").

Japanese Patent Application Laid-Open No. 2008-046297 discusses a configuration in which an opening of a corona charger is covered with a shutter to prevent the deposition of a discharge product to a photosensitive member when an image is not formed to solve the "image deletion". Specifically, the configuration is discussed that the shutter is moved for opening/closing along the longitudinal direction of the corona charger.

To solve the "image deletion", there is a method for preventing the moisture absorption of the discharge product by heating the photosensitive member or a method for removing the discharge product by polishing the photosensitive member. On the other hand, advantageously, with the arrangement of the shutter to the corona charger, energy required for heating is suppressed (energy saving) and a polishing amount of the photosensitive member is further suppressed, thereby extending the life of the photosensitive member.

The corona charger is arranged adjacently to the surface of the photosensitive member. Therefore, the shutter has to be arranged in a narrow gap. It is not preferable for the photosensitive drum to be rubbed by the shutter because the photosensitive member is damaged.

Then, as a result of dedicated study by the inventor, by disposing a holding member for regulating the variation in a sheet-like member at the edge of a sheet, the shutter could be provided in a narrow gap. Further, to prevent sagging-down of a sheet-like shutter along the longitudinal direction of the corona charger, it became apparent that it was preferable to apply urging force to the shutter with a sheet winding member along the longitudinal direction of the corona charger.

A charging wire of the corona charger needs to be replaced when it has been used for an operating life. However, the charging wire cannot be replaced in the corona charger having the shutter. Specifically, the holding member for suppressing the variation in sheets is disposed at the edge of the sheet-like shutter member, and the charging wire can be therefore replaced only by removing the shutter or setting the charging wire underneath.

SUMMARY OF THE INVENTION

The present invention is directed to a charging device capable of replacing a charging wire without operation for removing a shutter or setting a charging wire underneath.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

First of all, the entire configuration of an image forming apparatus is described with reference to FIG. 2. Then, a charging device is specifically described. The image forming apparatus according to the present exemplary embodiment is an electrophotographic laser beam printer.

<Entire Configuration of Image Forming Apparatus>

Figure 2:
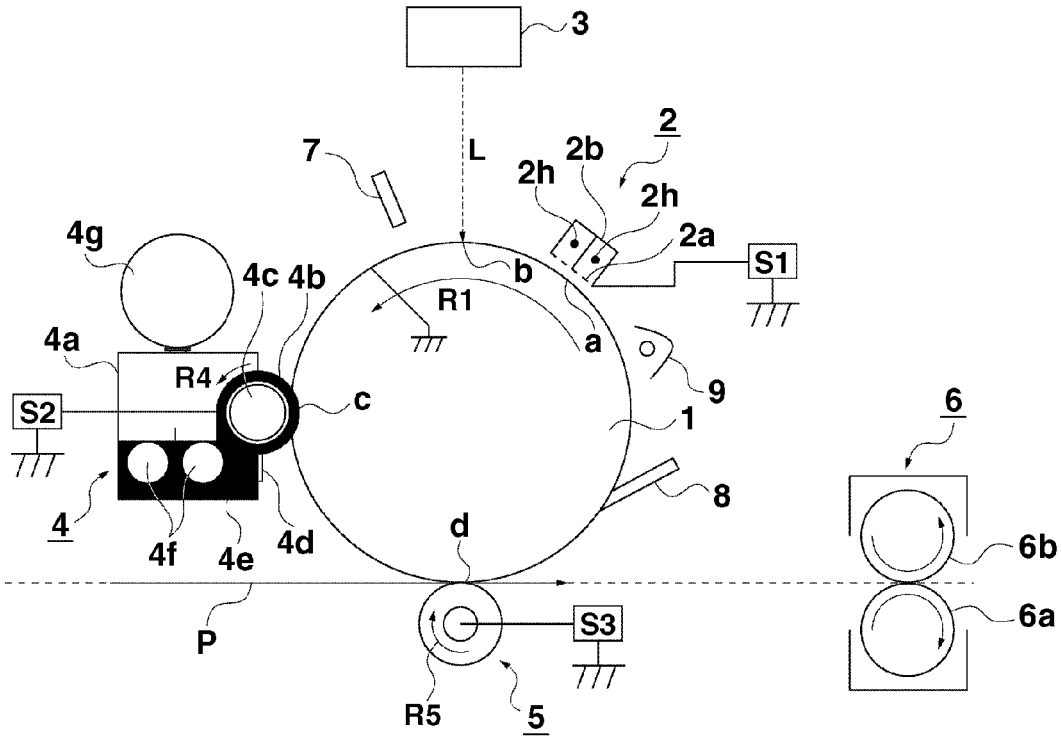
FIG. 2 illustrates a schematic configuration of an image forming apparatus.

Referring to FIG. 2, a charging device 2, an exposure device 3, a potential measuring device 7, a developing device 4, a transfer device 5, a cleaning device 8, and a light-neutralization device 9 are sequentially arranged along the rotation direction (direction of an arrow R1) of the photosensitive member (image bearing member) 1 therearound. On the downstream side of the transfer device 5 in the conveyance direction of a recording material P, a fixing device 6 is disposed. Individual image forming devices that form an image are sequentially described in details.

(Photosensitive Member)

Figure 1:
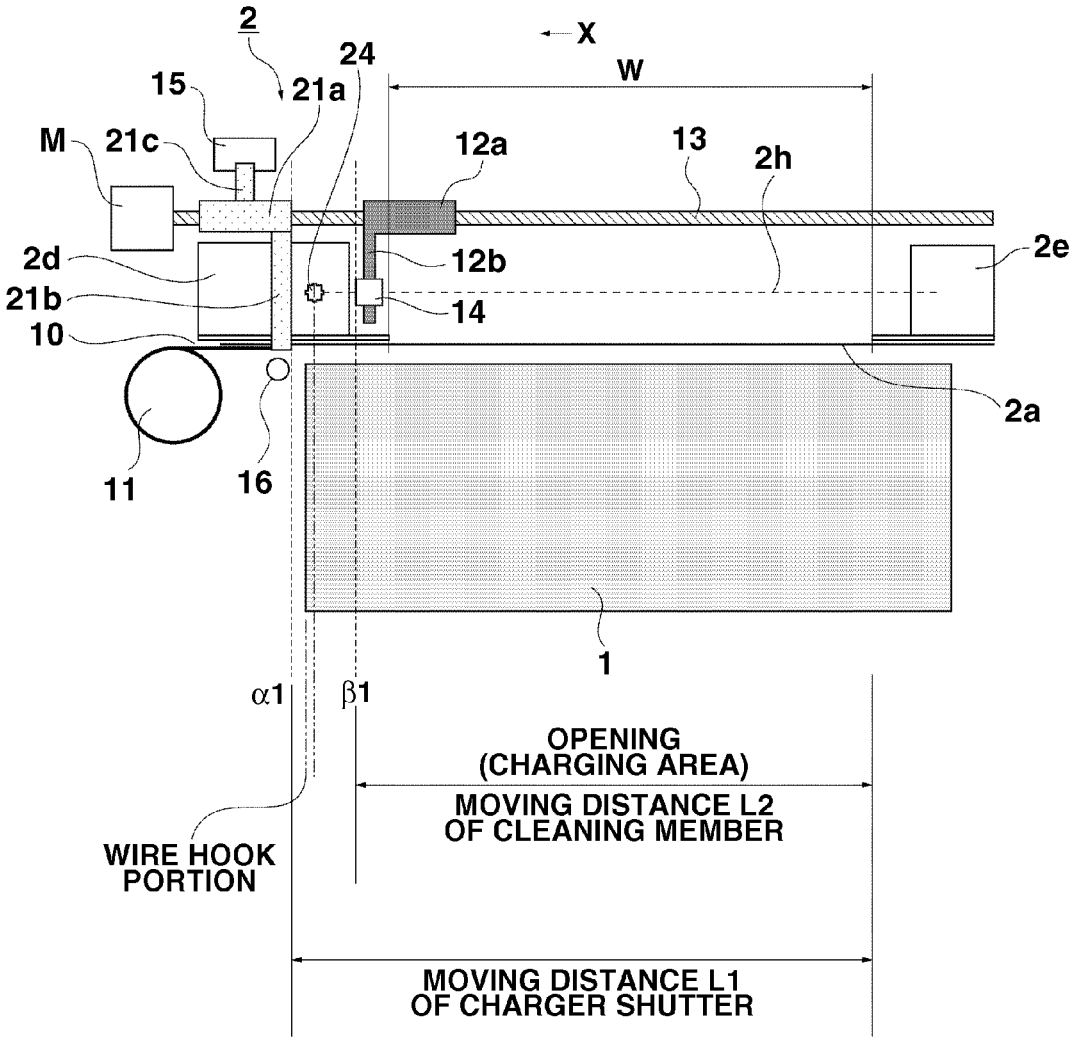
FIG. 1 illustrates an opened state of a shutter of a corona charger.

Referring to FIG. 2, the photosensitive member 1 as an image bearing member according to the present exemplary embodiment is cylindrical (drum-type) electrophotographic photosensitive member with a photosensitive layer, which is an organic photoconductor with negative charging characteristics. The photosensitive member 1 has a diameter of 84 mm, and is rotated with the central axis (not illustrated) as center at a process speed (circumferential speed) of 500 mm/sec in the direction of the arrow R1. Referring to FIG. 1, the width of the photosensitive member 1 in the longitudinal direction is 360 mm.

(Charging Device)

The charging device 2 according to the present exemplary embodiment is a scorotron-type corona charger including a discharging wire 2*h* as a charging electrode, a C-shaped conductive shield 2*b* disposed surrounding the discharging wire 2*h*, and a grid electrode 2*a* disposed to an opening of the shield 2*b*, as illustrated in FIG. 2.

According to the present exemplary embodiment, in order to deal with the speeding up of image formation, two discharging wires 2*h* are arranged. Corresponding to the arrangement, a corona charger is used having a partition to block a gap between the discharging wires 2*h* by the shield 2*b*.

As long as the photosensitive member 1 can be charged with the corona discharge, the discharging wire 2*h* may have a string shape or sawtooth wave pattern, and the shape of the discharging wire 2*h* is not limited thereto. The discharging wire 2*h* as the charging electrode is thin-wire-shaped, containing brown tungsten.

The corona charger 2 is disposed along the generatrix of the photosensitive member 1. Therefore, the longitudinal direction of the corona charger 2 is parallel with the axial direction of the photosensitive member 1. As illustrated in FIG. 1, the grid electrode 2*a* is disposed so that the central portion in the lateral direction (moving direction of the photosensitive member 1) is more projected toward the discharging wire side than both ends thereof along the circumferential surface of the photosensitive member 1.

In other words, the grid electrode 2*a* is arc-shaped along a curvature of a photosensitive member drum. Therefore, according to the present exemplary embodiment, the corona charger 2 is disposed more adjacently to the photosensitive member 1 than the conventional one, thereby improving the charging efficiency.

A power source S1 for applying a charging bias is connected to the corona charger 2. The corona charger 2 has a function for uniformly performing charging processing of the surface of the photosensitive member 1 with negative potentials at a charging position "a" by the charging bias applied from the power source S1. Specifically, the charging bias obtained by superimposing an AC voltage on a DC voltage is applied to the discharging wires 2*h* and the grid electrode 2*a*.

Further, the corona charger 2 according to the present exemplary embodiment includes a charger shutter for preventing adhesion of a discharge product generated by the charge to the photosensitive member 1. The configuration of the charger shutter is described later.

(Other Image Forming Devices)

An exposure device 3 according to the present exemplary embodiment is a laser beam scanner having a semiconductor laser that irradiates the photosensitive member 1 subjected to the charging processing by the corona charger 2 with a laser beam L. Specifically, the exposure device 3 outputs the laser beam L based on an image signal transmitted from a host computer connected to the image forming apparatus via a network cable.

The surface of the photosensitive member 1 that is subjected to the charging processing is exposed at an exposure position "b" in the main scanning direction with the laser beam L. The exposure along the main scanning direction is repeated while the photosensitive member 1 is rotating, thereby reducing the potential at a portion of the charged surface of the photosensitive member 1 to which the laser beam L is irradiated. An electrostatic latent image corresponding to image information is formed thereby.

The main scanning direction represents the direction in parallel with the generatrix of the photosensitive member 1. The sub scanning direction represents the direction parallel with the rotation direction of the photosensitive member 1.

The developing device 4 according to the present exemplary embodiment visualizes an image by adhering developer (toner) to the electrostatic latent image formed on the photosensitive member 1 with the charging device 2 and the exposure device 3. The developing device 4 according to the present exemplary embodiment uses a two-component magnetic brush development system, and further uses a reversal developing system.

A power source S2 for applying a developing bias is connected to a development sleeve 4*b*. The toner in the developer borne on the surface of the development sleeve 4*b* is selectively adhered, corresponding to the electrostatic latent image on the photosensitive member 1, with an electric field generated by the developing bias applied by the power source S2. Thus, the electrostatic latent image is developed as a toner image. According to the present exemplary embodiment, the toner is adhered to an exposure portion (irradiation portion of the laser beam L) on the photosensitive member 1 and the electrostatic latent image is reversal-developed.

According to the present exemplary embodiment, the transfer device 5 includes a transfer roller 5, as illustrated in FIG. 2. The transfer roller 5 is pressure-contacted to the surface of the photosensitive member 1 with a predetermined pressure, and a pressure-contact nip portion thereof becomes a transfer portion d. The recording material P (e.g., a paper sheet or transparent film) is fed to the transfer portion "d" from a paper cassette at a predetermined control timing.

The recording material P fed to the transfer portion "d" is sandwiched and carried between the photosensitive member 1 and the transfer roller 5, and then the toner image on the photosensitive member 1 is transferred to the recording material P. At this time, a transfer bias (+2 kV according to the present exemplary embodiment) with opposite polarity of normal charging polarity (negative polarity) is applied to the transfer roller 5 from a power source S3 for applying a transfer bias.

Referring to FIG. 2, the fixing device 6 according to the present exemplary embodiment includes a fixing roller 6*a* and a pressing roller 6*b*. The recording material P to which the toner image is transferred by the transfer device 5 is conveyed to the fixing device 6, and is heated and pressed by the fixing roller 6*a* and the pressing roller 6*b*. The toner image is fixed on the surface of the recording material P. The recording material P subjected to the fixing processing is thereafter discharged outside.

The cleaning device 8 according to the present exemplary embodiment includes a cleaning blade, as illustrated in FIG. 2. After the transfer device 5 transfers the toner image to the recording material P, the cleaning blade removes the residual transfer toner that remains on the surface of the photosensitive member 1.

The light-neutralization device 9 according to the present exemplary embodiment includes a discharge and exposure lamp, as illustrated in FIG. 2. In the photosensitive member 1 subjected to the cleaning processing by the cleaning device 8, the residual charge on the surface thereof is discharged with irradiation of laser beam from the discharge and exposure lamp.

A series of image forming processing with the image forming devices ends and the operation is in a standby mode for the next image formation.

<Specific Configuration of Charging Device>

The configuration of the charging device is described below in detail.

(Charger Shutter)

First of all, the charger shutter 10 as a sheet-like member that opens/closes an opening of the corona charger 2 is described. The opening of the corona charger 2 indicates an opening formed to the shield, corresponding to a charging area (W in FIG. 1) of the corona charger 2. Therefore, the charging area W of the corona charger 2 approximately matches an area where the photosensitive member 1 can be charged.

Figure 3:
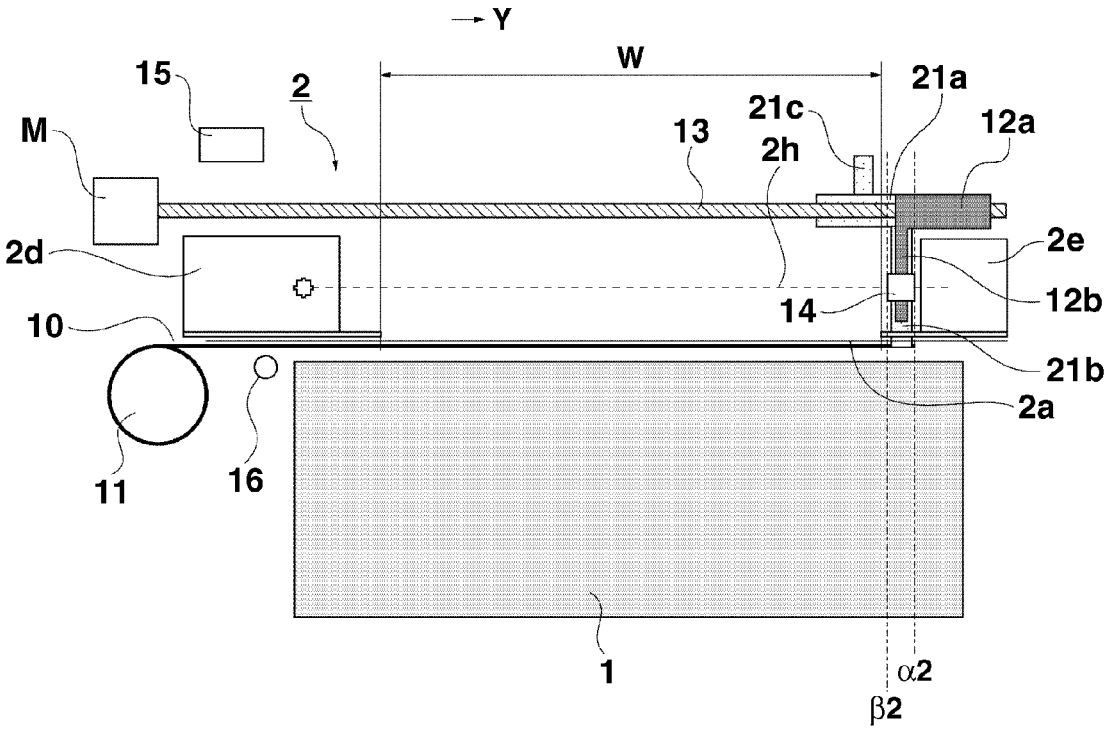
FIG. 3 illustrates a closed state of the shutter of the corona charger.

FIG. 1 illustrates a state in which the charger shutter 10 as the sheet-like member is opened by being wound up to move the charger shutter 10 in the X direction (opening direction). FIG. 3 illustrates a state in which the charger shutter 10 as the sheet-like member is closed by being unwound to move the charger shutter 10 in the Y direction (closing direction).

According to the present exemplary embodiment, as illustrated in FIGS. 1 and 3, a shutter (hereinafter, referred to as a charger shutter) like a cut sheet is used as the charger shutter 10 that opens/closes the opening of the corona charger 2 by being wound in a rolled shape by a winding unit 11.

The reason is that it is possible to prevent the passage of corona product falling from the corona charger 2 to the photosensitive member 1. In addition, the charger shutter 10 is moved in a narrow gap between the photosensitive member 1 and the grid electrode 2*a*, and therefore, a soft sheet-like shutter is used to prevent the damage to the photosensitive member 1 when the charger shutter 10 comes into contact with the photosensitive member 1.

Specifically, as the charger shutter 10, sheet-like polyimide resin with thickness of 30 μm is employed. Further, the charger shutter 10 is rolled and retreated to one end side of the corona charger 2 in the longitudinal direction (main scanning direction) during the image forming operation because of reduction in space when retreating (open state) the charger shutter 10.

(Plate Spring as Moving Member and Regulation Member)

As a mechanism for opening/closing the charger shutter 10, a plate spring is disposed at the sheet end, and the opening of the charger shutter 10 is opened/closed by holding the plate spring. The plate spring disposed to the sheet end regulates the shape of the charger shutter 10 with elasticity, as a regulation member. The plate spring is arched toward the upper side in the direction of gravitational force (i.e., projected in the direction of the grid side).

The plate spring regulates the sheet-like charger shutter 10 to be projected. As a result, the charger shutter 10 obtains the rigidity to prevent sagging-down to the side of the photosensitive member 1. The plate spring may apply the rigidity to the sheet-like charger shutter 10 enough to prevent the sagging-down of the charger shutter 10 to the photosensitive member 1. Thus, the plate spring is disposed at the position of 1 to 3 mm from the end of the sheet-like charger shutter 10.

With the charger shutter 10 having high rigidity, the plate spring can be disposed at the position of 5 mm from the end of the charger shutter 10. However, the charger shutter 10 with high rigidity has high possibility for damaging the photosensitive member 1, as compared with the charger shutter 10 with low rigidity.

According to the present exemplary embodiment, as the charger shutter 10, a polyimide resin sheet with thickness of 30 μm is employed. As the regulation member for regulating the sheet to be projected in the upper direction, the plate spring is arranged at the position of 2 mm from the end of the charger shutter 10.

The plate spring that regulates the charger shutter 10 is connected to a first moving member 21 as a holding member and a C-shaped arm. By moving the first moving member 21, the opening of the charger shutter 10 is opened/closed.

(Drive Mechanism of Charger Shutter)

Figure 4A:
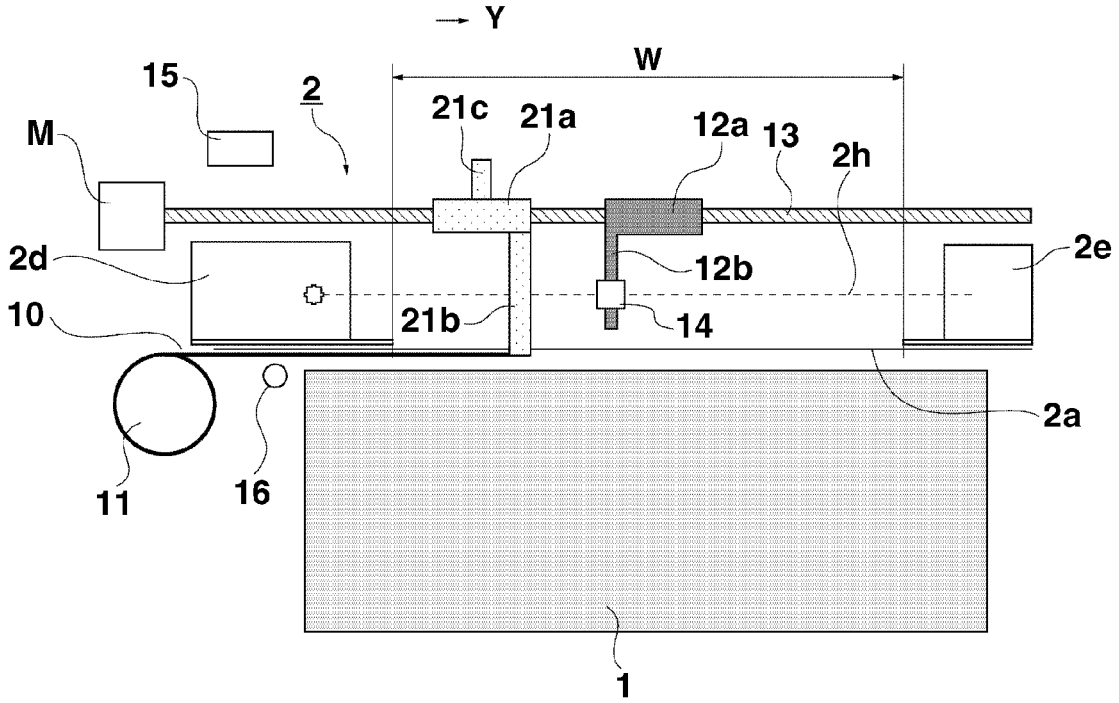
FIGS. 4A and 4B illustrate a closing operation state of the shutter of the corona charger.
Figure 4B:
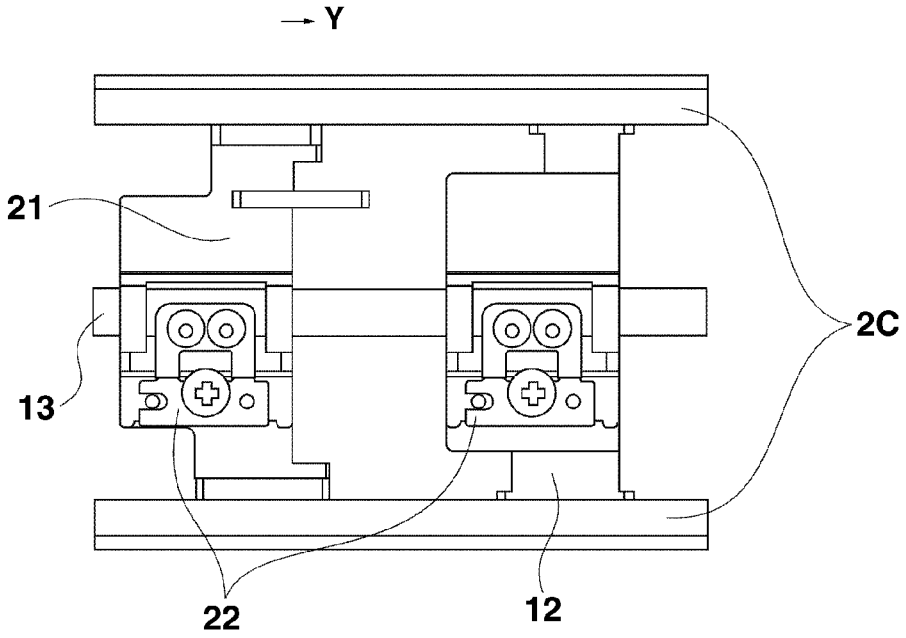
Figure 6:
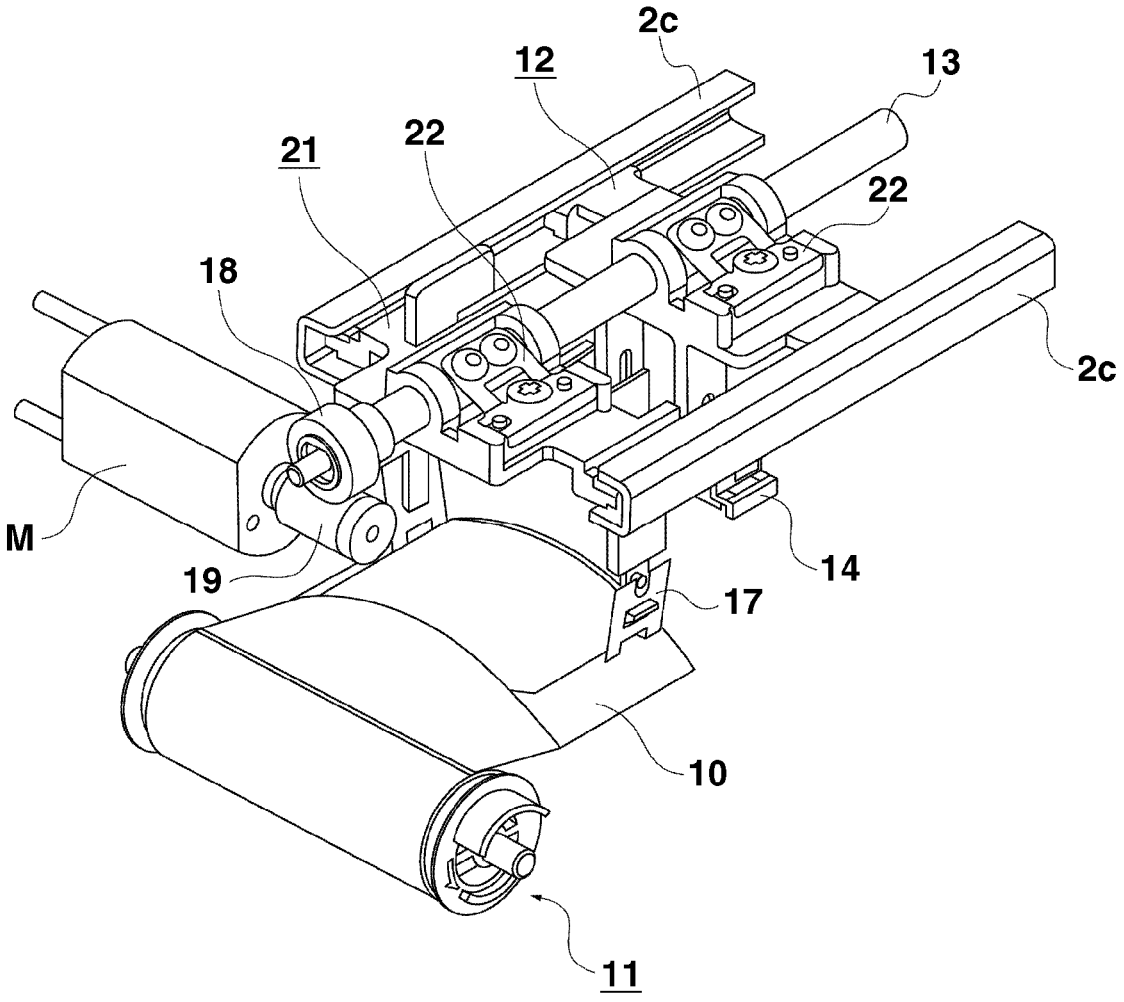
FIG. 6 illustrates a mechanism for opening and closing the shutter of the corona charger.
Figure 11:
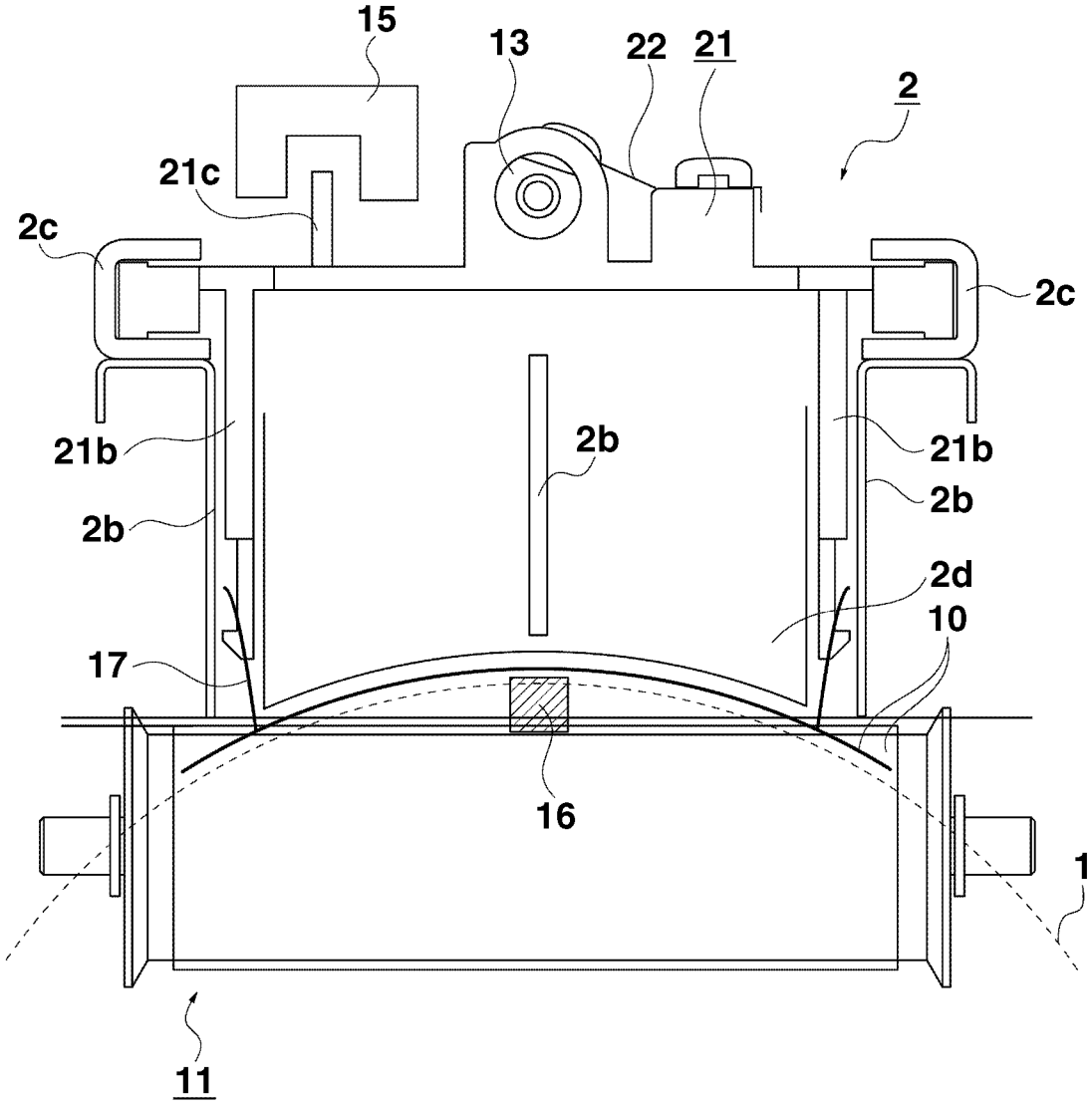
FIG. 11 is a schematic diagram illustrating the corona charger in the lateral direction.

An opening/closing mechanism (moving mechanism) of the charger shutter 10 is described next. FIGS. 1, 4A, and 4B illustrate opening and closing states of the charger shutter 10. FIG. 6 is a perspective view illustrating the details of the opening/closing mechanism. FIG. 11 is a cross-sectional view illustrating the corona charger 2 viewed from one end side thereof in the longitudinal direction.

The opening/closing mechanism includes a drive motor M, the winding unit 11, the first moving member 21 that holds the charger shutter 10, a second moving member 12 that holds a cleaning member 14, and a rotation member 13. With these components, the charger shutter 10 can be opened and closed along the longitudinal direction (main scanning direction).

As illustrated in FIGS. 1 and 11, a shutter detection device 15 is arranged to detect the end of opening operation of the charger shutter 10. The shutter detection device 15 includes a photointerrupter. The shutter detection device 15 can detect the end of opening operation of the charger shutter 10 by using the operation in which the photo interrupter is shielded with a light shielding member 21*c*, when the first moving member 21 reaches the end position of the opening operation.

In other words, when the shutter detection device 15 detects the light shielding member 21*c* of the first moving member 21, the rotation of the drive motor M stops.

As illustrated in FIGS. 1 and 6, on the leading end of the charger shutter 10 in the closing direction, a shutter fixing member 17 is disposed so that the central portion thereof is projected to the corona charger 2 more than both ends of the charger shutter 10 in the lateral direction. In other words, the shutter fixing member 17 functions as regulation means that regulates the shape of the charger shutter 10.

The shutter fixing member 17 is locked and fixed to a connection member 21*b* integrally provided for the first moving member 21. The first moving member 21 and the second moving member 12 have a drive transmission member 22 arranged to be screwed with the rotation member 13, and are connected to the rotation member 13 via the drive transmission member 22 to be driven.

Further, the first moving member 21 and the second moving member 12 are screwed to be movable on a rail 2*c* disposed on the corona charger 2 only in the main scanning direction, thereby preventing the rotation of the first moving member 21 and the second moving member 12 together with the rotation member 13.

As illustrated in FIG. 6, the rotation member 13 has a spiral groove, and a gear 18 is connected to one end thereof. A worm gear 19 is connected to the front end of the drive motor M, thereby transmitting drive force of the drive motor M to the rotation member 13 via an engagement portion between the worm gear 19 and the gear 18.

The drive motor M rotates the rotation member 13, thereby moving the first moving member 21 and the second moving member 12 in the main scanning directions (the X and Y directions) along the spiral groove. Therefore, the drive motor M drives the rotation member 13, thereby transmitting movement force in the opening/closing direction to the charger shutter 10 via the connection member 21*b* integrated with the first moving member 21.

The second moving member 12 integrally includes a connection member 12*b* that holds the cleaning member 14 for cleaning the discharging wire 2*h*. Therefore, simultaneously with the movement of the charger shutter 10 in the main scanning directions (the X and Y directions) by the drive motor M, the cleaning member 14 is also moved in the same direction. Thus, the drive motor M enables the cleaning operation of the discharging wire 2*h* and the operation of the charger shutter 10.

(Winding Mechanism of Charger Shutter)

Figure 7:
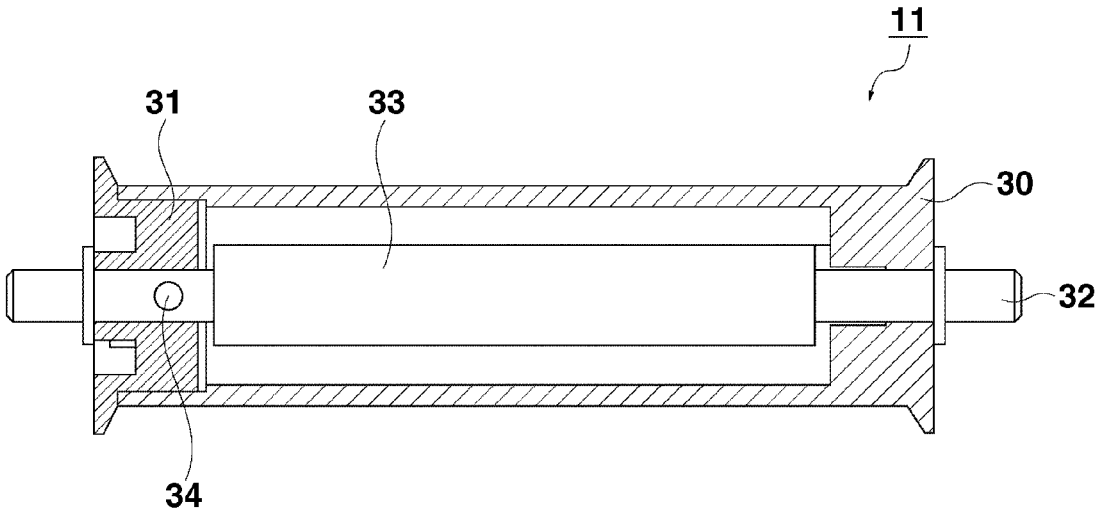
FIG. 7 illustrates a schematic configuration of a shutter winding unit.
Figure 8:
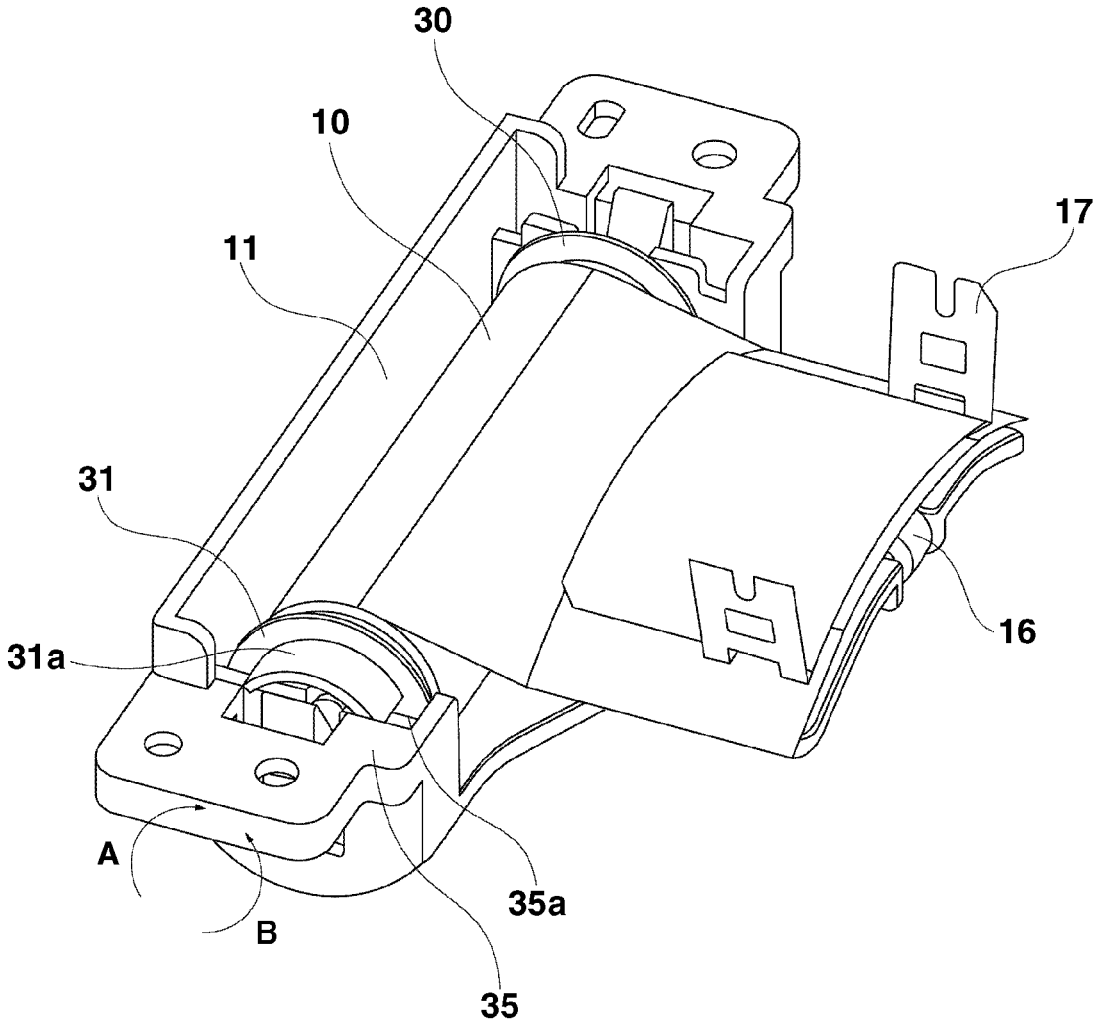
FIG. 8 is a schematic perspective view illustrating a state for setting the shutter winding unit to a guide member.

Next, the winding mechanism of the charger shutter 10 is described. FIG. 7 illustrates a configuration of the winding unit 11 as winding means. FIG. 8 illustrates a state in which the winding unit 11 is attached to a guide fixing member 35 used for attaching the winding unit 11 to the corona charger 2.

The winding unit 11 includes a cylindrical winding roller (winding member) 30 that fixes one end side of the charger shutter 10 and winds the charger shutter 10, a shaft member 32 that pivotally supports the winding roller 30, and a bearing member 31 that pivotally supports the other end of the winding roller 30. Further, the winding unit 11 includes a parallel pin 34 as a fixing member that fixes the bearing member 31 and the shaft member 32, and a spring (urging member) 33 that is disposed in the winding roller 30 and is engaged with the winding roller 30 and the bearing member 31.

As illustrated in FIG. 8, the winding unit 11 is attached to the guide fixing member 35 to contact a projection 31*a* of the bearing member 31 to a rib 35*a* of the guide fixing member 35. With this configuration, the bearing member 31 and the shaft member 32 are fixed not to be rotatable, and only the winding roller 30 is pivotally supported to be rotatable.

Before attaching the bearing member 31 to the guide fixing member 35, the winding roller 30 is fixed. In the fixing state, the bearing member 31 is wound with several numbers of rotations in a B direction and is attached to the guide fixing member 35 to generate rotational force of the bearing member 31 in an A direction.

Thus, when unwinding the charger shutter 10 in the opening direction (Y direction) thereof, torsion force generated by a spring 33 operates in a direction for winding the charger shutter 10 by the winding roller 30. In this case, the bearing member 31 receives the force in the A direction and then collided with the guide fixing member 35, thereby being fixed not to be rotatable.

In order to prevent the sagging down of the charger shutter 10 when the charger shutter 10 is moved in the opening direction, winding force needs to be applied in advance to the winding unit 11 to prevent the charger shutter 10 from sagging down. According to the present exemplary embodiment, as illustrated in FIG. 1, the winding force of the winding unit 11 is the weakest at the position where the charger shutter 10 is moved to the end position of the operation.

Therefore, winding force F1 at the position is set as a lower limit of the winding force for preventing the sagging down of the charger shutter 10, and the number of rotations of the bearing member 31 in the B direction is determined before the attachment to the guide fixing member 35.

Therefore, when opening the charger shutter 10 (refer to FIG. 1), as the drive motor M moves the charger shutter 10 in the X direction, the winding roller 30 winds the charger shutter 10 as needed without sagging down the charger shutter 10.

On the other hand, when closing the charger shutter 10 (refer to FIG. 3), against the urging force of the spring 33 provided in the winding roller 30, the charger shutter 10 is unwound from the winding roller 30 by the drive motor M, thereby moving the charger shutter 10 in the Y direction.

When the charger shutter 10 is completely closed, the urging force in the X direction generated by the spring 33 provided in the winding roller 30 operates on the charger shutter 10. Therefore, the charger shutter 10 is not sagged down. Further, one end of the charger shutter 10 is regulated with arch shape while being held by the winding unit 11, and the other end thereof is regulated with the plate spring.

The gap between the charger shutter 10 and the corona charger 2 cannot be easily formed when closed, thereby enabling the corona product not easily to leak out.

(Moving Range of Charger Shutter)

Figure 5A:
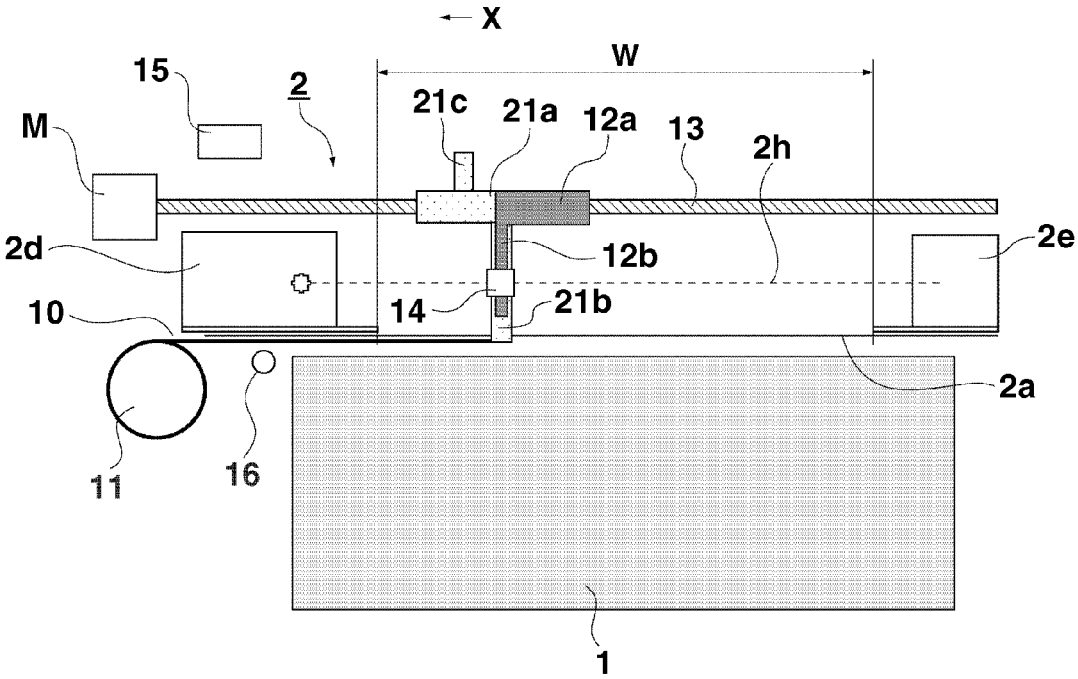
FIGS. 5A and 5B illustrate an opening operation state of the shutter of the corona charger.
Figure 5B:
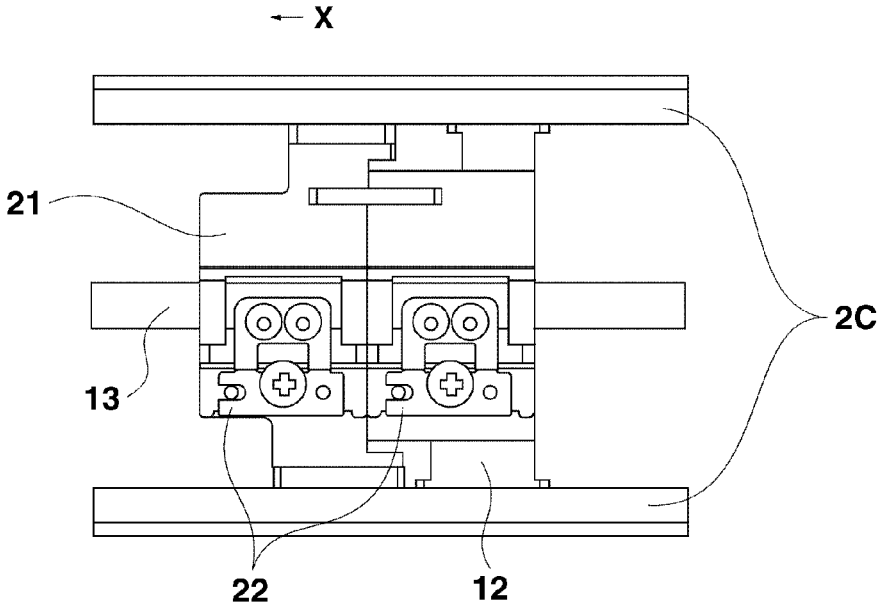
Figure 9:
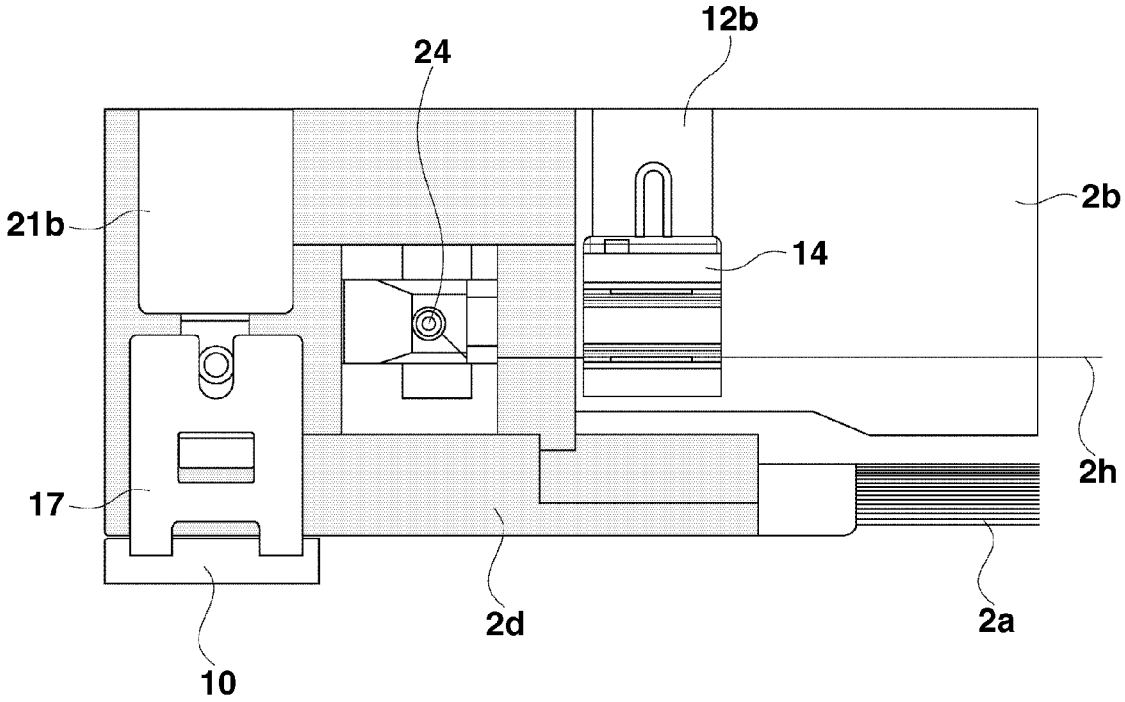
FIG. 9 illustrates a fixed state of a discharging wire.

FIG. 1 illustrates the opened state of the charger shutter 10. FIG. 3 illustrates the closed state of the charger shutter 10. FIGS. 4A and 4B illustrate a state where the charger shutter 10 is being moved in the Y direction (closing direction). FIGS. 5A and 5B illustrate a state where the charger shutter 10 is being moved in the X direction (opening direction). FIG. 9 is an enlarged view around an attachment portion of the discharging wire 2*h* in the opened state of the charger shutter 10.

According to the present exemplary embodiment, the first moving member 21 and the second moving member 12 change the moving distance between the charger shutter 10 and the cleaning member 14.

As illustrated in FIG. 1, in the opened state of the charger shutter 10, the first moving member 21 and the second moving member 12 stop at opened positions α1 and β1, respectively. At the opened positions α1 and β1, the shutter detection device 15 that detects the end of the opening operation of the charger shutter 10 detects the first moving member 21, and stops the opening operation.

Of a leading position α of the charger shutter 10 and an end surface β of the winding side of the cleaning member 14, open positions α1 and β1 are positioned on the winding member side with respect to the discharging area W. More specifically, the opened position α1 of the charger shutter 10 is positioned on the winding member side of the charger shutter 10 with respect to the side end of the drum of the photosensitive member 1. The discharging wire 2*h* as the charging electrode is supported to be replaceable by a wire hook member 24 as a supporting member.

The wire hook member 24 includes a hook for the discharging wire 2*h* and a screw for fixing the hooked discharging wire 2*h*. When replacing the discharging wire 2*h*, the discharging wire 2*h* is unfixed by loosening the screw, and the old discharging wire 2*h* is thereafter detached from the hook. Then, the other discharging wire 2*h* is hooked and fixed by the screw.

Further, as illustrated in FIGS. 1 and 9, at the open position β1 as the stop position of the second moving member 12, the entire cleaning member 14 is stopped on the winding side with respect to the discharging area W. On the other hand, the open position α1 as the stop position of the first moving member 21 is positioned on the winding side with respect to the wire hook member 24 for the discharging wire 2*h*.

The open position α1 is positioned on the winding side with respect to the wire hook member 24 (i.e., on the winding side with respect to the open position β1), thereby enabling the replacement of the discharging wire 2*h* without detaching the charger shutter 10.

Further, the open position α1 of the first moving member 21 is set on the winding side with respect to the side end surface of the photosensitive member 1. At usual operation time, even if the photosensitive member 1 is rotated, it is possible to prevent the charger shutter 10 from contacting the photosensitive member 1.

According to the present exemplary embodiment, in the charging device having a narrow gap between the photosensitive member 1 and the corona charger 2, if the open position α1 is set on the surface of the photosensitive member 1, the charger shutter 10 can be contaminated by adhering the toner on the drum. Further, the charger shutter 10 may be grazed to the rotating photosensitive member 1, and the photosensitive member 1 can be damaged or the charger shutter 10 can be broken. Therefore, the configuration according to the present exemplary embodiment is employed.

When the charger shutter 10 is closed, as illustrated in FIG. 4A, the first moving member 21 and the second moving member 12 are moved in the Y direction while keeping the gap of the open positions.

As illustrated in FIG. 3, the charger shutter 10 is collided with a block 2*e* positioned on the depth side, and stops at close positions α2 and β2. In this case, with respect to the first moving member 21 and the second moving member 12, the second moving member 12 first collides with the block 2*e*, and stops at the closing position β2. Then, the first moving member 21 collides with the second moving member 12. After elapse of a predetermined time from the start of movement, the drive operation of the motor M stops and the closing operation of the charger shutter 10 ends.

In this case, the first moving member 21 and the second moving member 12 are unevenly shaped and collide with each other as illustrated in FIGS. 4B and 5B. The charger shutter 10 and the cleaning member 14 thus stop at the close positions α2 and β2, which are the similar positions.

The close positions α2 and β2 are set on the block 2*e* side with respect to the discharging area W. Further, the close positions α2 and β2 substantially coincide with each other. Alternatively, the close position α2 is set closer to the block 2*e* side than the closing position β2, thereby enabling the entire area of the discharging wire 2*h* in the longitudinal direction to be covered with the charger shutter 10.

When the charger shutter 10 is opened, as illustrated in FIG. 5A, the first moving member 21 and the second moving member 12 keep the state at the closing time, and are moved in the X direction in the contact state. As illustrated in FIG. 1, the first moving member 21 collides with a shielding plate, the second moving member 12 collides with a block 2*d* on the front side, and stop at the open positions α1 and β1, respectively.

In this case, with respect to the first moving member 21 and the second moving member 12, the second moving member 12 first collides with the block 2*d* and stops at the open position β1. Further, the first moving member 21 still continues to move, collides with the shielding plate, and stops at the open position α1. In this case, the shutter detection device 15 detects the first moving member 21, and stops the drive motor M. Then, the opening operation of the charger shutter 10 ends.

With the difference in stop positions thereof, the open position matches the wire replacing position. The charger shutter 10 is arranged without the damaging the replaceability of the discharging wire 2*h* at the service time.

Figure 12A:
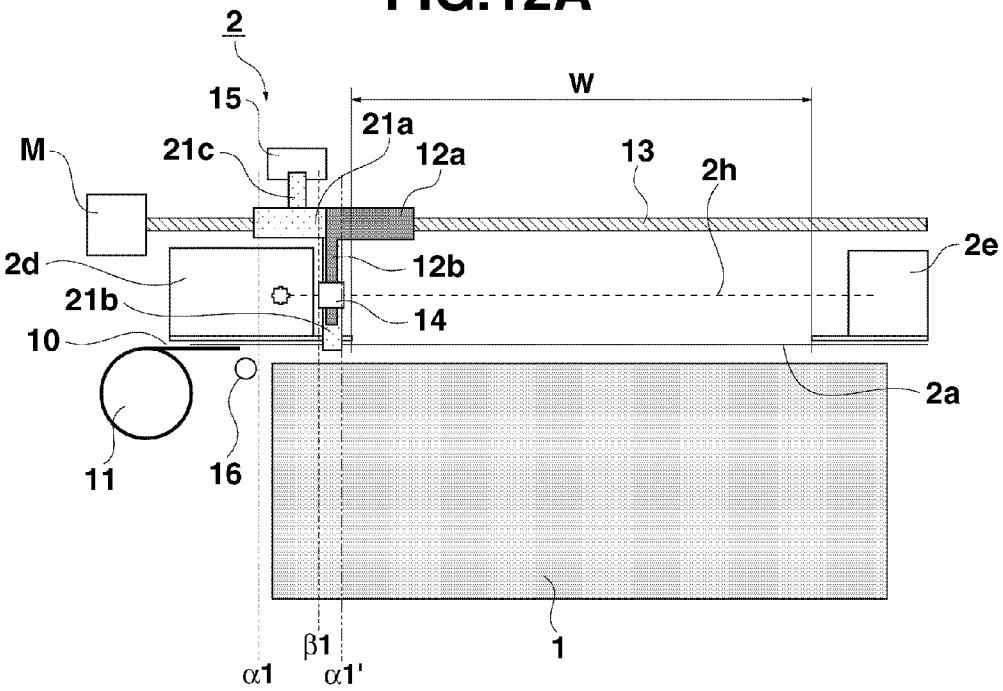
FIGS. 12A and 12B illustrate an opened state of the shutter of the corona charger.
Figure 12B:
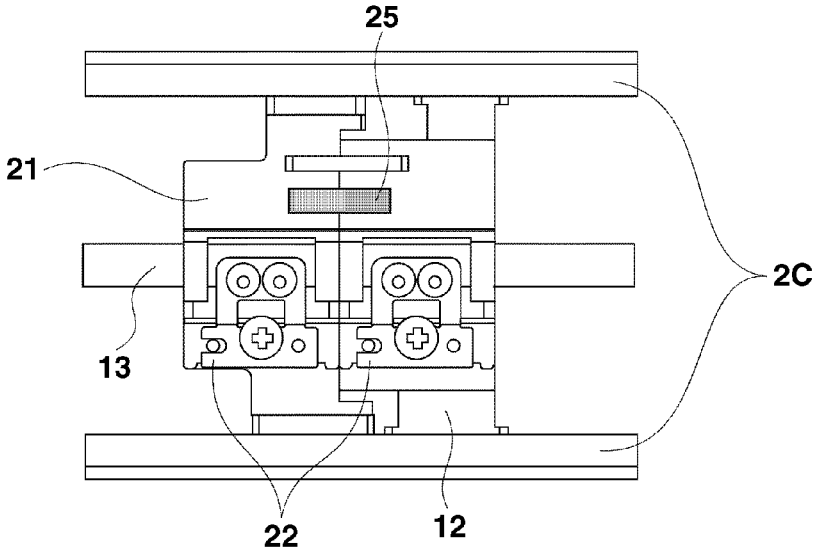

According to the present exemplary embodiment, the corona charger 2 in which the open position matches the wire exchanging position is exemplified. If a charger with a wide gap between the photosensitive member 1 and the corona charger 2 is used, the charger shutter 10 can be waited on the photosensitive member 1. Then, as illustrated in FIG. 12A, the first moving member 21 and the second moving member 12 are fixed in a state illustrated in FIG. 12B with an engagement member 25, and the configuration can be used in which the wire replacing position does not match the open position.

In this case, the first moving member 21 and the second moving member 12 are operated in contact with each other. An open position α1' substantially coincides with the open position β1, similar to the relationship between the close positions. Alternatively, the open position α1' is closer to the block 2*e* than the open position β1.

Only at the service time, the engagement member 25 is released, thereby enabling the separation of the first moving member 21 and the second moving member 12. Thus, the first moving member 21 is moved toward the open position α1 on the winding side more than the wire hook member 24. The open position α1 is positioned on the winding side more than the wire hook member 24 (i.e., on the winding side more than the open position β1).

By setting "the moving distance L1 of the charger shutter 10 to be longer than the moving distance L2 of the cleaning member 14", the space for replacing the discharging wire 2*h* can be provided around the wire hook member 24. As a consequence, a service engineer can easily replace the discharging wire 2*h*.

(Positioning Configuration of Charger Shutter)

Figure 10:
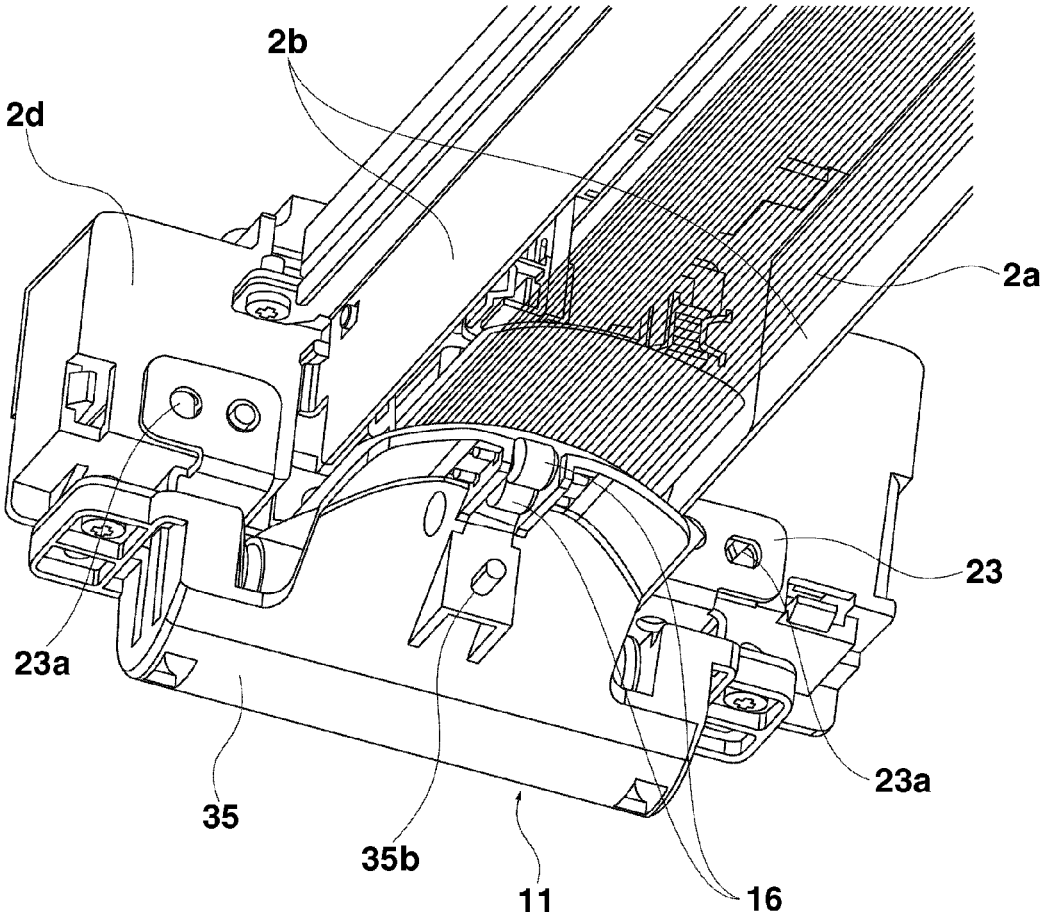
FIG. 10 is a perspective view illustrating a positioning member of the corona charger.

The positioning configuration of the charger shutter 10 will be described next. FIG. 10 is a perspective view illustrating a positioning member 23 for attaching the corona charger 2 to the device main body. As illustrated in FIG. 10, a grid electrode is arranged to an opening of a shield along the longitudinal direction of the opening of the shield.

At assembling time, the corona charger 2 is deflected with tension generated by stretching the grid electrode 2*a*. When attaching the corona charger 2 to the device main body, a gap between the photosensitive member 1 and the grid electrode 2*a* can be different in the longitudinal direction. If the difference of the gaps is large, the difference in density on an output matter in the main scanning direction can be caused.

The height on the front side to the depth side of the grid electrode 2*a* (to the photosensitive member 1) in the corona charger 2 is first measured after stretching the grid electrode 2*a* to prevent the difference. In order to set the difference in height on the front side relative to the depth side of the grid electrode 2*a* to 50 μm or less, the positioning member 23 as a reference member to the block 2*d* on the front side is adjusted to be assembled to the corona charger 2.

Thus, the positioning accuracy of the corona charger 2*a* is ensured. Further, the guide fixing member 35 that supports and fixes the charger shutter 10 is attached to the positioning member 23.

If disposing the guide fixing member 35 that supports and fixes the charger shutter 10 to the block 2*d*, when the deflection of the corona charger 2 is large, even if the gap between the grid electrode 2*a* and the photosensitive member 1 keeps a predetermined amount or less, the position of the block 2*d* relative to the photosensitive member 1 can be varied.

If the guide fixing member 35 is fixed to the block 2*d* while varying the position of the block 2*d* to the photosensitive member 1, with the influence of the block 2*d*, the position of a guide member 16 is positioned on the central side of the photosensitive member 1 more than the outer circumferential surface of the photosensitive member 1. Therefore, the charger shutter 10 may collide with a drum end surface (side surface) of the photosensitive member 1, thereby causing an operation failure. When varying the position of the block 2*d* on the opposite side, the gap between the guide member 16 and the grid electrode 2*a* is eliminated. Then, the charger shutter 10 may be stuck and an operation failure can be thus caused.

In order to prevent the failure, according to the present exemplary embodiment, the guide fixing member 35 that supports and fixes the charging shutter 10 is attached to the positioning member 23 as a reference member. Thus, irrespective of the state of the corona charger 2, it is possible to ensure the positioning accuracy of the photosensitive member 1 and the guide member 16.

According to the present exemplary embodiment, a positioning projection 35*b* is disposed to the guide fixing member 35 to ensure the positioning accuracy of the guide member 16 and the photosensitive member 1. The positioning projection 35*b* and a positioning hole 23*a* of the positioning member 23 are positioned with respect to the positioning members that are provided on the member to which the photosensitive member 1 of the device main body (not illustrated) is positioned.

Thus, the photosensitive member 1, the corona charger 2 (grid electrode 2*a*), and the guide fixing member 35 (guide member 16) can be positioned to the same member with high accuracy.

That is, a moving member that movably holds the charger shutter 10 and a cleaning tool for the charging wire in the longitudinal direction is provided for each of the charger shutter 10 and the cleaning tool. The moving member of the charger shutter 10 can be moved at the distance longer than that of the moving member of the cleaning tool. As a consequence, the charging wire can be easily replaced in a state where the charger shutter 10 is attached.

According to the present exemplary embodiment, the positioning member 23 is adjusted and fixed to the corona charger 2. Alternatively, the positioning member 23 can be applied to a corona charger in which the photosensitive member 1 and the height of the grid electrode 2*a* can be changed with an adjusting screw in a state where the corona charger is assembled in the device main body. In this case, the gap between the grid electrode 2*a* and the guide member 16 needs to be not narrower than an operable width (moving range) of the charger shutter 10.

As described above, according to the present exemplary embodiment, the first moving member 21 and the second moving member 12 are provided, and the relationships between the open positions $\alpha 1$ and $\beta 1$ and the closing positions $\alpha 2$ and $\beta 2$ are set. As a consequence, the charger shutter 10 surely covers the discharging area W, and the replaceability of the charging wire does not deteriorate even in a state where the charger shutter 10 is attached.

According to the exemplary embodiment, in preceding process in which the corona charger forms the electrostatic image on the photosensitive member, the photosensitive member is substantially uniformly subjected to the charging processing. However, the present invention is not limited thereto. When the corona charger performs the charging processing on the toner image formed on the photosensitive member, the present invention can be also applied.

According to the exemplary embodiment, the grid electrode is provided at the opening of the corona charger. Alternatively, when the grid electrode is not provided at the corona charger, the present invention can be also applied.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-052016 filed Mar. 9, 2010, which is hereby incorporated by reference herein in its entirety.

What is claimed is:

1. A charging device comprising:

a charging electrode;

a supporting member configured to replaceablely support the charging electrode;

a shield including an opening;

a sheet-like shutter configured to open and close the opening of the shield along the longitudinal direction of the shield;

a winding member configured to wind the shutter from one end; and a holding member configured to hold the other end of the shutter and be movable along the longitudinal direction of the shield to the winding member side more than the supporting member.

2. The charging device according to claim 1, further comprising:

a cleaning member configured to clean the charging electrode; and a drive unit configured to drive the cleaning member and the holding member, wherein the holding member has a moving range wider than that of the cleaning member.

3. An image forming apparatus comprising:

a rotatable photosensitive member; and the charging device according to claim 2, wherein the holding member stops between a side end of the photosensitive member and the winding member.

4. A charging device comprising:

a discharge wire disposed along a longitudinal direction of the charging device;

a housing surrounding the discharge wire and including an opening opposed to a charged member;

a shutter configured to open and close the opening of the housing along the longitudinal direction of the charging device;

a supporting member including a supporting portion configured to support an end of the discharge wire on a side of a direction in which the shutter is opened;

a holding member configured to hold the shutter; and a moving mechanism configured to move the holding member along the longitudinal direction of the charging device, wherein an end of the shutter in a direction in which the shutter is closed is movable to a downstream of the supporting portion in the direction in which the shutter is opened.

5. The charging device according to claim 4, wherein the holding member is fixed to the end of the shutter in the direction in which the shutter is closed.

6. The charging device according to claim 5, further comprising:

a cleaning member configured to come into contact with the discharge wire and clean the discharge wire, wherein the moving mechanism is configured to move the cleaning member along the longitudinal direction of the charging device, and wherein a movable range of the holding member is larger than a movable range of the cleaning member.

7. The charging device according to claim 4, further comprising:

a winding member configured to wind the shutter when the shutter is opened.

8. An image forming apparatus comprising:

a photosensitive member; and a charging device configured to charge the photosensitive member, the charging device including:

a discharge wire disposed along a longitudinal direction of the charging device;

a housing surrounding the discharge wire and including an opening opposed to the photosensitive member;

a shutter configured to open and close the opening of the housing along the longitudinal direction of the charging device;

a holding member configured to hold the shutter; and a moving mechanism configured to move the holding member along the longitudinal direction of the charging device, wherein an end of the shutter in a direction in which the shutter is closed is movable to a downstream of both side ends of the photosensitive member in the direction in which the shutter is opened.

9. The image forming apparatus according to claim 8, wherein the holding member is fixed to the end of the shutter in the direction in which the shutter is closed.

10. The image forming apparatus according to claim 8, further comprising a winding member configured to wind the shutter when the shutter is opened, wherein an end of the shutter in the direction in which the shutter is closed is movable to the downstream of the both side ends of the photosensitive member and an upstream of the winding member in the direction in which the shutter is opened.

11. The charging device according to claim 4, wherein the supporting portion is a hook configured to hook the end of the discharge wire on a side of a direction in which the shutter is opened.

12. The charging device according to claim 4, wherein the supporting member is a first supporting member, the charging device further comprising a second supporting member configured to support an end of the discharge wire on a side of a direction in which the shutter is closed.

* * * * *